US008360514B2

(12) United States Patent
Chen et al.

(10) Patent No.: US 8,360,514 B2
(45) Date of Patent: Jan. 29, 2013

(54) HIGH CHAIR FOLDING DEVICE AND HIGH CHAIR THEREOF

(75) Inventors: Shun-Min Chen, Taipei (TW); Wen-Qu Hu, Taipei (TW); Xiao-Jian Zhang, Taipei (TW)

(73) Assignee: Wonderland Nurserygoods Co., Ltd., Neihu, Taipei (TW)

( * ) Notice: Subject to any disclaimer, the term of this patent is extended or adjusted under 35 U.S.C. 154(b) by 352 days.

(21) Appl. No.: 12/719,863

(22) Filed: Mar. 9, 2010

(65) Prior Publication Data

US 2010/0264703 A1 Oct. 21, 2010

(30) Foreign Application Priority Data

Apr. 15, 2009 (CN) ..... 2009 1 0135001

(51) Int. Cl.
*A47D 1/02* (2006.01)

(52) U.S. Cl. ..... 297/16.1; 297/51; 297/55

(58) Field of Classification Search ..... 297/16.1, 297/51, 148, 55
See application file for complete search history.

(56) References Cited

U.S. PATENT DOCUMENTS

| | | | | |
|---|---|---|---|---|
| 4,191,397 | A * | 3/1980 | Kassai | 280/647 |
| 5,104,180 | A | 4/1992 | Takahashi | |
| 5,707,104 | A | 1/1998 | Perego | |
| 6,126,236 | A | 10/2000 | Wu | |
| 7,334,836 | B2 | 2/2008 | Chen | |
| 2003/0067193 | A1 * | 4/2003 | Asbach et al. | 297/16.1 |
| 2005/0248186 | A1 * | 11/2005 | Wang | 297/148 |
| 2007/0194609 | A1 * | 8/2007 | Chen | 297/16.1 |
| 2007/0290527 | A1 * | 12/2007 | Chen et al. | 297/16.1 |
| 2009/0295198 | A1 * | 12/2009 | Tomasi | 297/16.1 |

* cited by examiner

*Primary Examiner* — Peter Brown
*Assistant Examiner* — Philip Gabler
(74) *Attorney, Agent, or Firm* — Winston Hsu; Scott Margo

(57) ABSTRACT

A folding device is configured at the bottom of rear leg frame and at the pivot between the rear leg frame and front leg frame of a high chair. The folding device allows a user to complete folding process by pressing a button at the bottom of the rear leg frame. When the button is pressed, a rotator in the housing of the folding device rotates correspondingly and drags connected steel wires to move horizontally inward. The other ends of the steel wires further connect to engaging parts at the pivots and engaging between the front leg frame and the rear leg frame and retract the engaging parts so that the rear leg frame disengages from and pivots about the front leg frame. The high chair may be folded with one-foot operation.

12 Claims, 14 Drawing Sheets

HIGH CHAIR FOLDING DEVICE AND HIGH CHAIR THEREOF

BACKGROUND OF THE INVENTION

1. Field of the Invention

The present invention relates to a high chair having a folding device, and more specifically, to a high chair capable of folding with single foot remotely.

2. Description of the Prior Art

High chairs used for infants or toddlers bring much convenience for care givers when taking care of the child. With their greater height, the high chairs raise children sitting in the seat to a fairly high situation for a seated care giver. Most high chairs according to the prior art have foldability for storage. The frame body of the high chair may be folded and compacted to a smaller size after the folding process. The seat of the high chair may also be detached, which means it can be removed from the frame body as the high chair is to be compacted and stored. Detachable design of the seat may also meet the requirement of manufacturing efficiency and modulization.

Foldability feature of the high chair can be provided by using various ways in the prior art knowledge. Moving the front leg frame and the rear leg frame to close to each other after releasing a retaining device supported between the frames is also disclosed in many relative papers. For example, U.S. Pat. Nos. 6,126,236, 5,104,180, and 7,334,836B2 disclose high chairs that make use of an additional lateral supporting frame between the front leg frame and the rear leg frame. Since the supporting frame has fixed length and is attached to the front leg frame and the rear leg frame with its two ends, relative position of the front leg frame and the rear leg frame can be maintained when the supporting frame is configured in an engaging position. To fold the front leg frame and the rear leg frame, an engaging device on the supporting frame is operated so that the two leg frames may be folded. The U.S. Pat. No. 5,707,104 provides a high chair that links a foldable supporting frame between the bottom pipes of the front leg frame and the rear leg frame. When the high chair is at an unfolding position, the supporting frame maintains the front leg frame and the rear leg frame at the unfolding position. To fold the high chair, users can step on an actuator at the supporting frame and the bottom pipe to fold the supporting frame, and approach the front leg frame to the rear leg frame.

Either way of folding mechanisms applied on the high chair according to the prior art needs additional lateral supporting frame or pipe configuring between the front leg frame and the rear leg frame of the frame body. The high chair can be folded only by directly operating a folding device configured on the supporting frame or supporting pipe. There is a need of an easy and convenient way of operation to fold a high chair for care givers.

SUMMARY OF THE INVENTION

The invention provides a high chair including a seat, a frame body for supporting the seat, and a folding device. The frame body includes a front leg frame and a rear leg frame, wherein a first end of the rear leg frame pivots to the front leg frame, and the rear leg frame is capable of rotating relative to the front leg frame between an unfolding position and a folding position. The folding device allows the rear leg frame for pivoting relative to the front leg frame. The folding device includes an engaging part slidably mounted on the first end of the rear leg frame, wherein the engaging part is capable of engaging with the front leg frame for securing the rear leg frame at the unfolding position, a housing mounted on the rear leg frame and away from the engaging part, an actuator mounted on the housing and moveable along a first direction relative to the housing, and a linking part connected between the actuator and the engaging part. The actuator is capable of moving the engaging part to disengage from the front leg frame.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
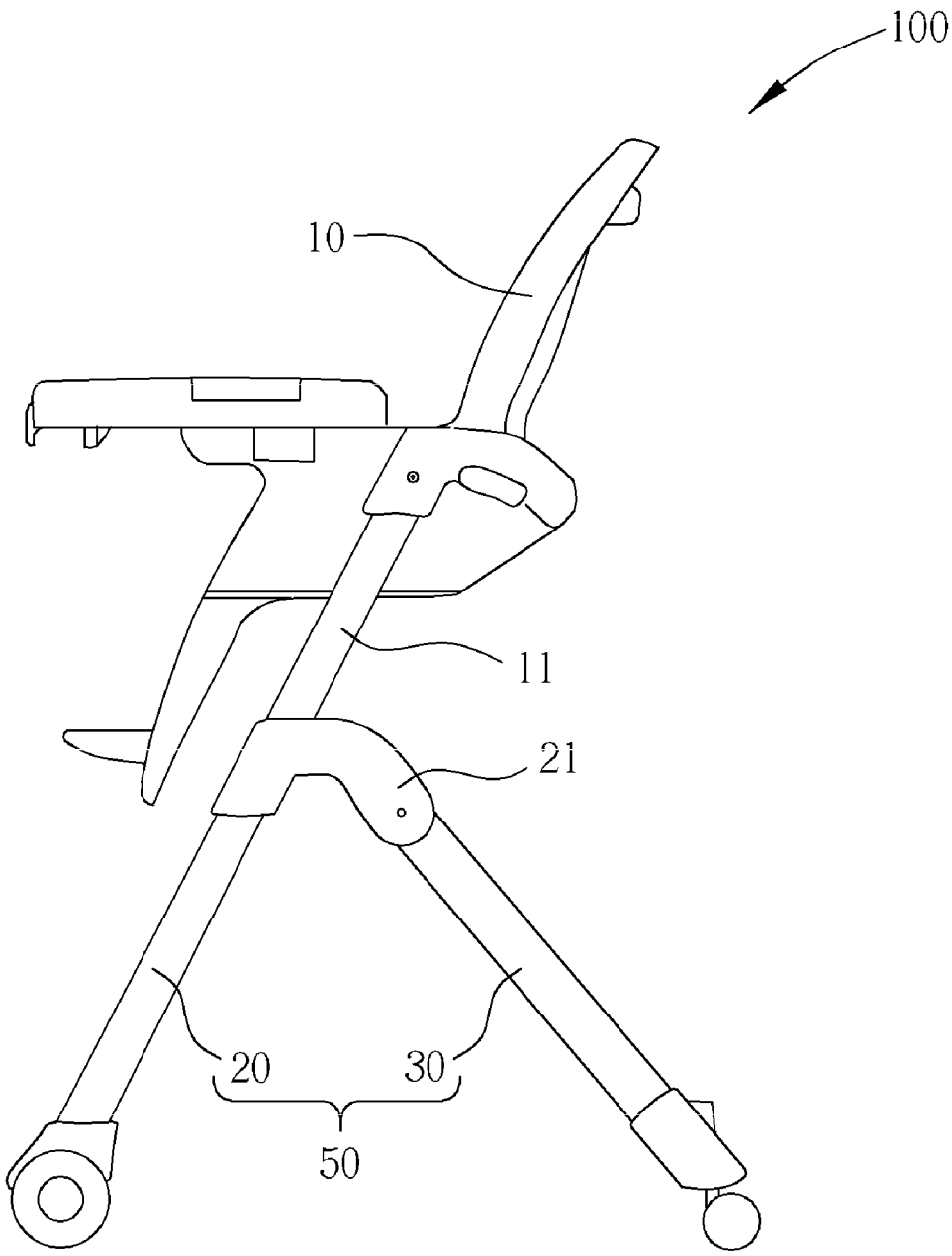
FIG. 1 is a schematic diagram of a high chair according to an embodiment of the invention in an unfolding position.
Figure 2:
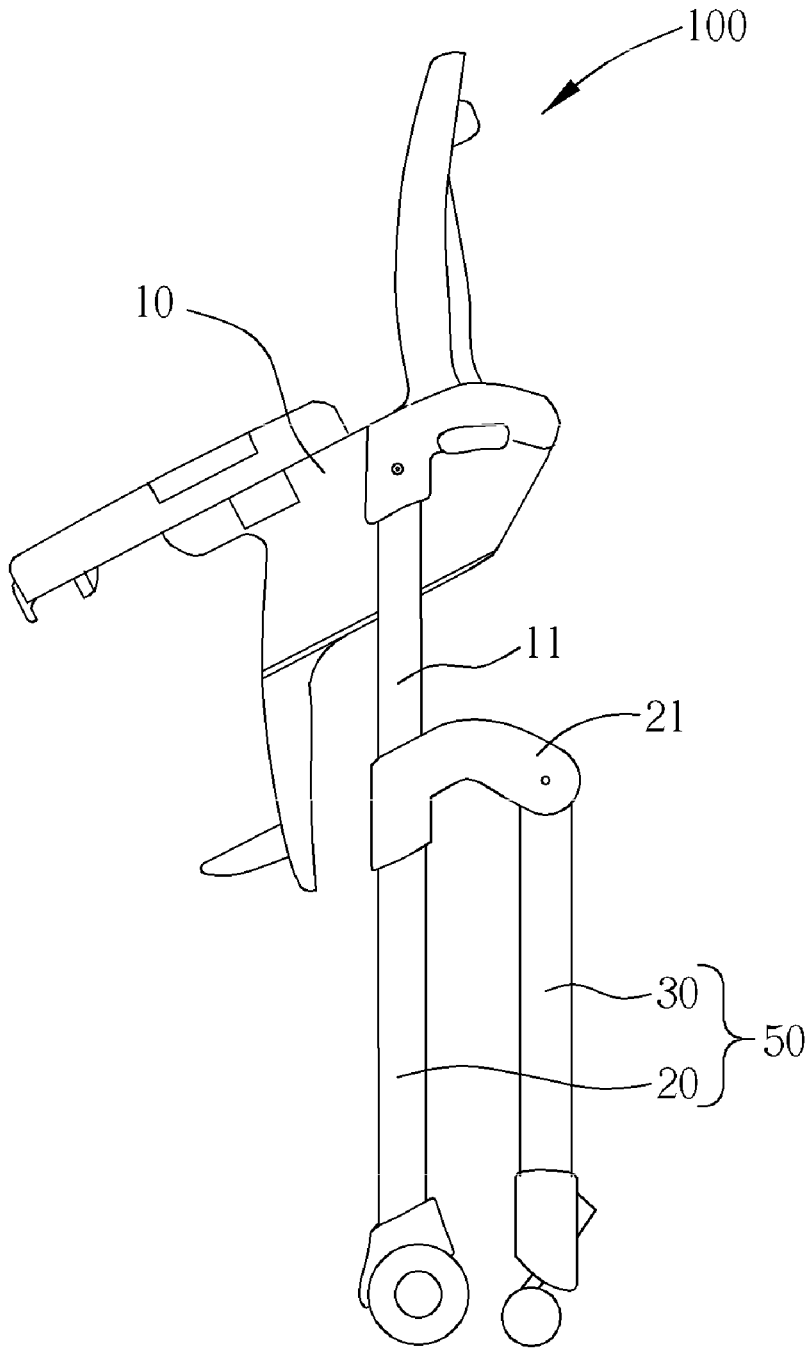
FIG. 2 is a schematic diagram of the high chair in a folding position.
Figure 3:
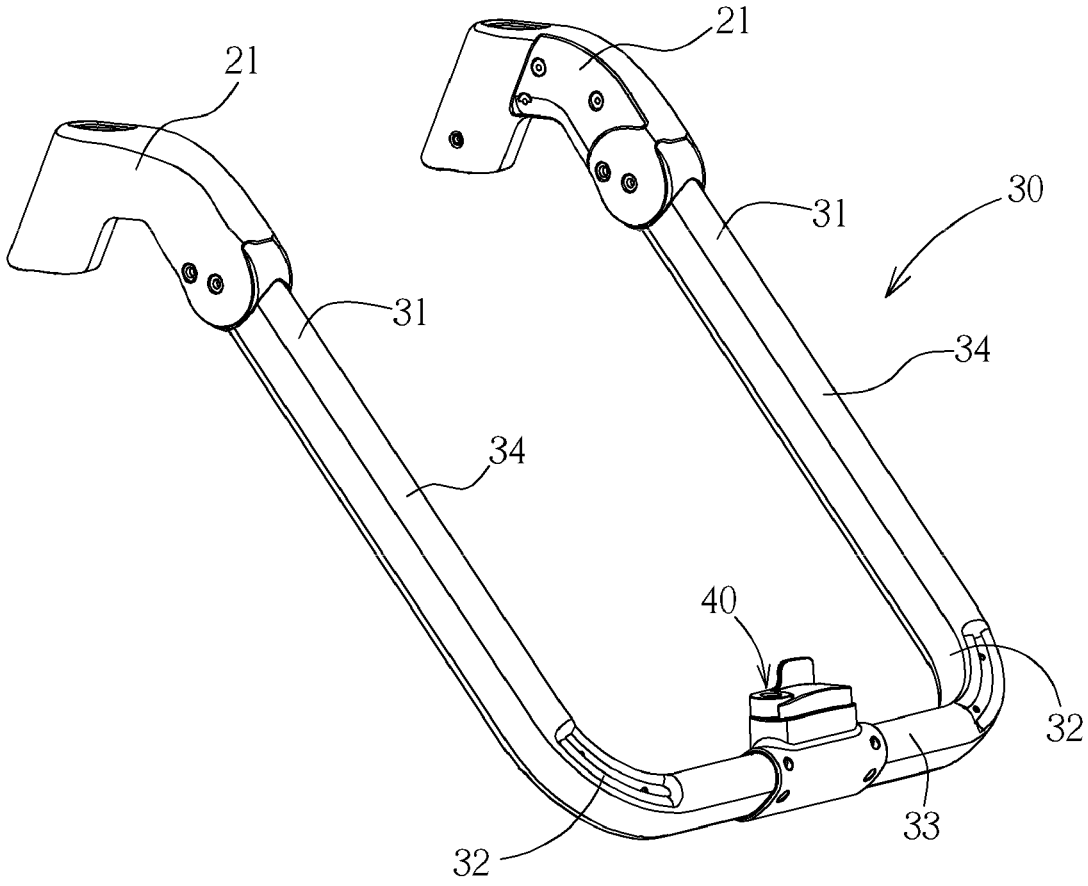
FIG. 3 is a schematic diagram of a folding device mounted on the rear leg frame according to a first embodiment of the invention.

Please refer to FIG. 1 and FIG. 2 that disclose an embodiment of a high chair 100 according to the invention. FIG. 1 is a schematic diagram showing the high chair 100 in an unfolding position and FIG. 2 is a schematic diagram showing the high chair 100 in a folding position. The high chair 100 includes a frame body 50 composed of a front leg frame 20 and a rear leg frame 30, a folding device 40 (shown in FIG. 3), and a seat 10 supported by the frame body 50. According to the embodiment, the seat 10 includes a height adjustment device 11 capable of moving relative to the front leg frame 20, which makes the seat 10 adjustable to a specific height and the seat 10 may also be detached from the frame body 50 for storage. The seat 10 can also be attached fixedly to the frame body 50 in other embodiments of the invention. In this embodiment, both the front leg frame 20 and the rear leg frame 30 may be U-shape tubes (FIG. 3 shows the U-shape rear leg frame 30 according to this embodiment) or the front leg frame 20 may be two parallel tubes. The front leg frame 20 has a pivoting segment 21 and the rear leg frame 30 pivots to the front leg frame 20 at the pivoting segment 21. The rear leg frame 30 can fold to a folding position as shown in FIG. 2 or extend to an unfolding position as shown in FIG. 1. The pivoting segment 21 may be an individual component or part of the front leg frame 20. In other embodiments, the individual pivoting segment 21 sleeves on each end of the front leg frame 20 and pivotally connects to the rear leg frame 30 at an extending end.

Please refer to FIG. 3, which shows a schematic diagram of a folding device 40 mounted on the rear leg frame 30 according to a first embodiment of the invention. The folding device 40 provides a user for remotely folding the frame body 50 by foot. In the first embodiment, the rear leg frame 30 has two parallel connecting pipes 34 and a bottom pipe 33 connected between two second ends 32 of both connecting pipes 34. Two first ends 31 of the connecting pipes 34 of the rear leg frame 30 connect pivotally to the pivoting segments 21 of the front leg frame 20, at both sides. The connecting pipes 34 and the bottom pipe 33 connect to form a U-shape frame. The folding device 40 includes an engaging assembly 401 and an actuating assembly 402. The engaging assembly 401 includes an engaging part 44, a linking part 45, a spring 46, and a spindle 47 shown in FIG. 4, and the actuating assembly 402 is mounted on the bottom pipe 33 further illustrated in FIG. 7 and FIG. 8 in detail. By cooperation with the engaging assembly 401 and the actuating assembly 402, the rear leg frame 30 can be secured in position with the front leg frame 20 or be released to rotate relative to the front leg frame 20.

Figure 4:
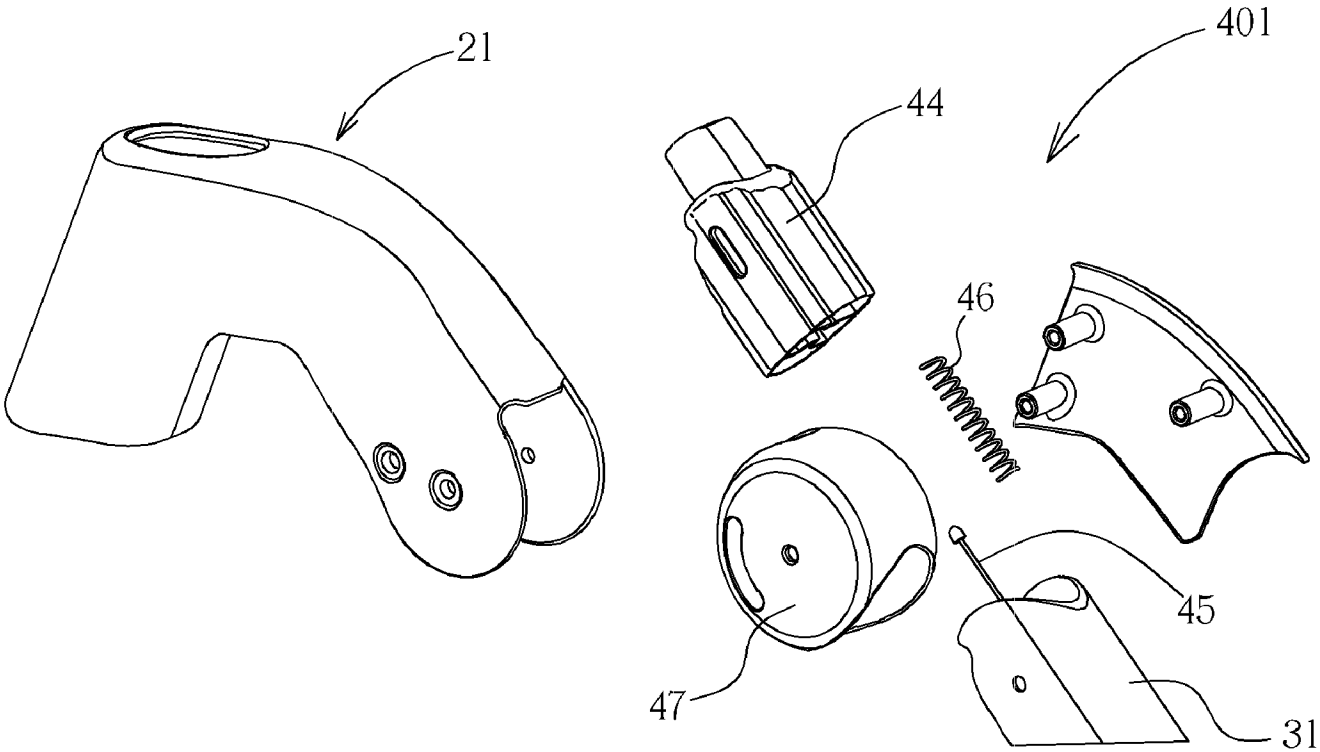
FIG. 4 is a schematic diagram of an engaging assembly of the folding device and the pivot of the front leg frame and the rear leg frame.

FIG. 4 shows a schematic diagram of the engaging assembly 401 of the folding device 40 and the pivoting segment 21 of the front leg frame 20 and the rear leg frame 30. The spindle 47 of the engaging assembly 401 is mounted on the first end 31 of the rear leg frame 30 and the engaging part 44 is mounted in the spindle 47. The spindle 47 may also be rotatably pivoted to the pivoting segment 21, and the engaging part 44 is slidable in the spindle 47 along the first end 31 of the rear leg frame 30. The engaging part 44 further connects to the actuating assembly 402 of the folding device 40, which situates at the bottom pipe 33 of the rear leg frame 30 via the linking part 45, which may be a steel wire and configured within the hollow pipe of the rear leg frame 30 in this embodiment. Through the linking part 45, the actuating assembly 402 moves the engaging part 44 to slide relative to the spindle 47 and the first end 31 of the rear leg frame 30 and to slip into the cavity of the spindle 47 and the connecting pipe 34, and a first elastic part (a spring 46 in this embodiment) connected between the engaging part 44 and the first end 31 of the rear leg frame 30 will be compressed as the engaging part 44 is pulled by the actuating assembly 402 to slide toward the second end 32 of the rear leg frame 30.

Figure 5:
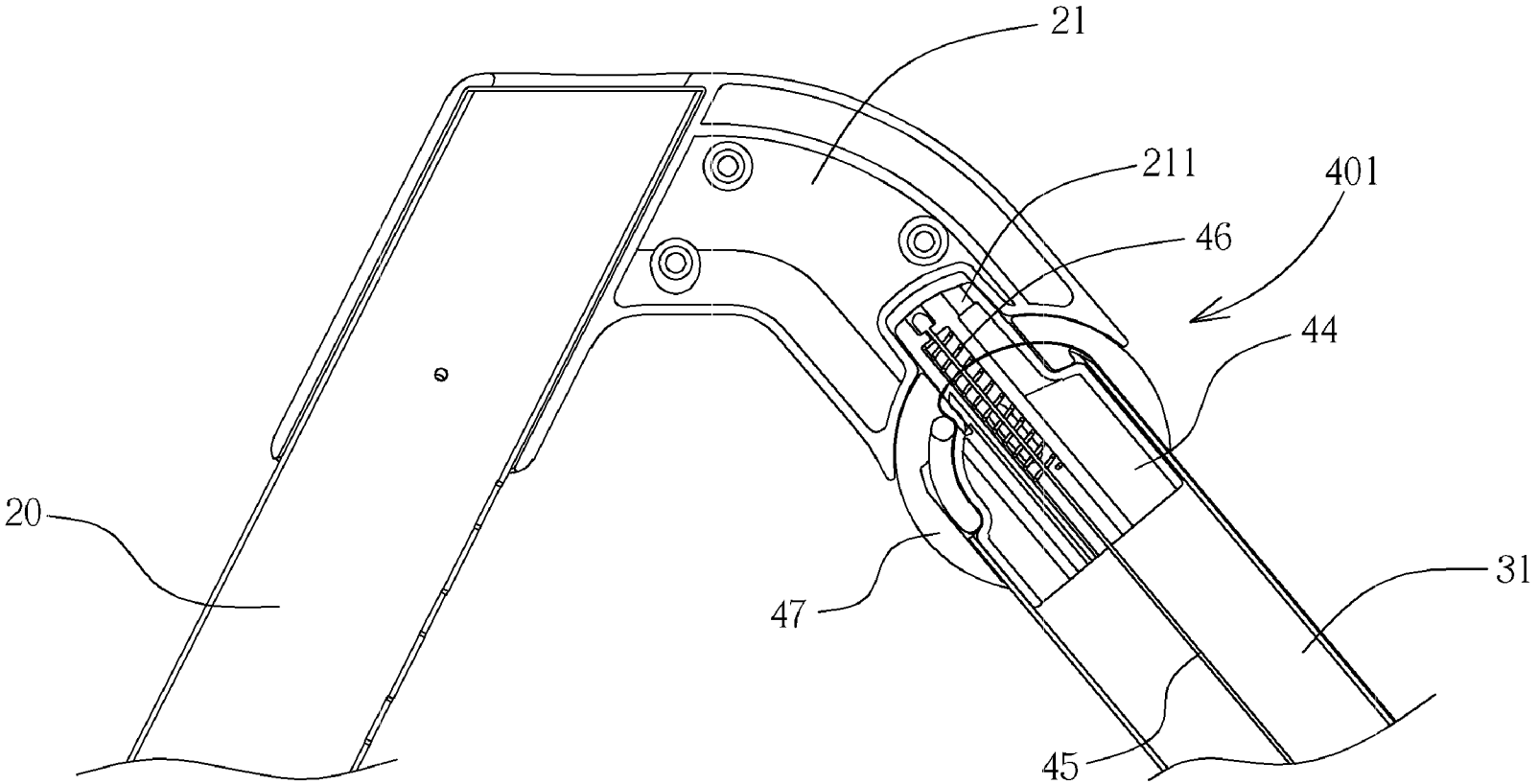
FIG. 5 is a schematic diagram of an engaging part securing the rear leg frame at the unfolding position.
Figure 6:
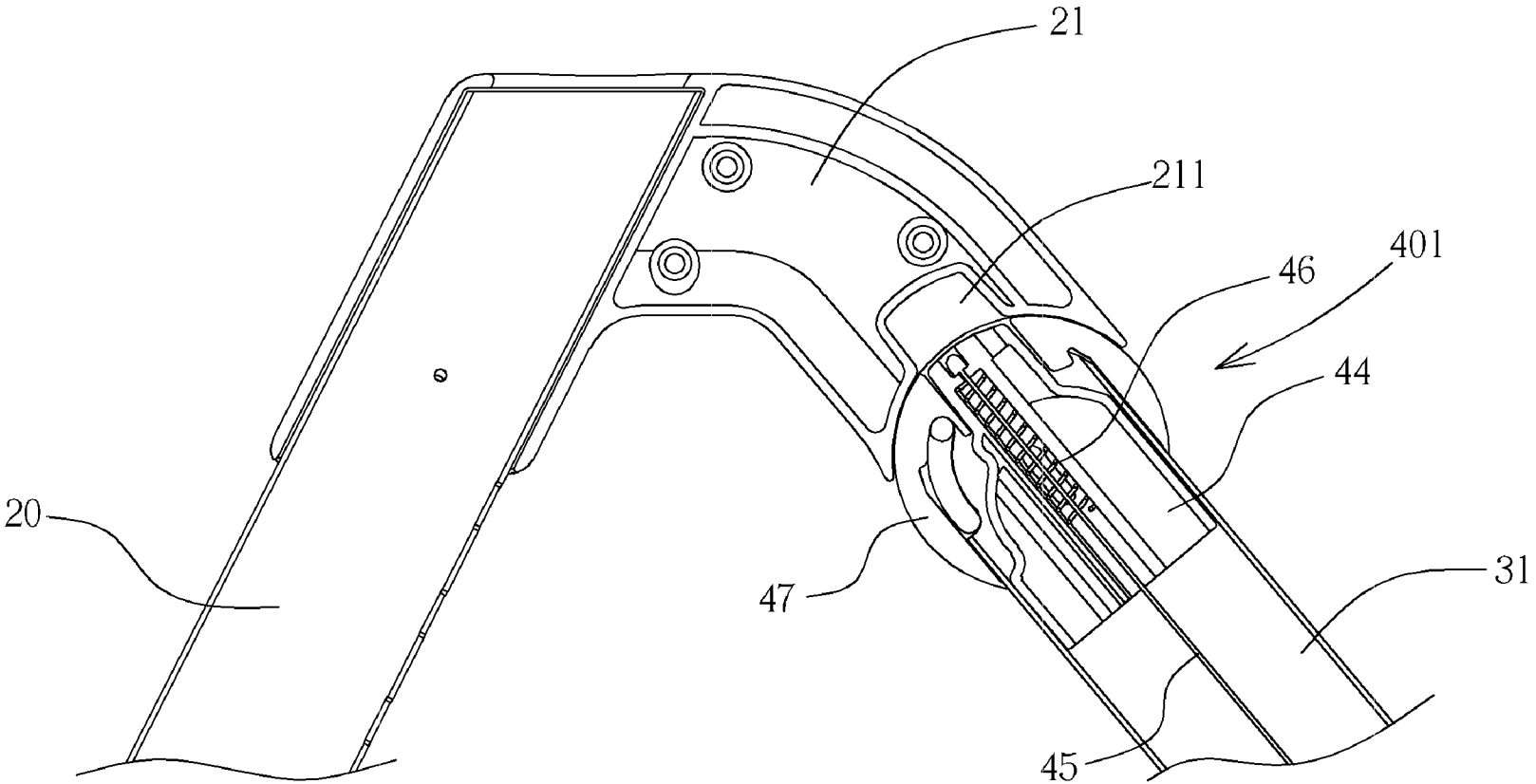
FIG. 6 is a schematic diagram of the engaging part releasing the rear leg frame.

FIG. 5 shows a schematic diagram of the engaging part 44 securing the rear leg frame 30 at the unfolding position and FIG. 6 shows a schematic diagram of the engaging part 44 having been released from the engagement between the front leg frame 20 and the rear leg frame 30. When the rear leg frame 30 is configured at the unfolding position as shown in FIG. 5, the engaging part 44 is pushed by the restoring stress of the spring 46 and extends out of the spindle 47 to engage with a recess 211 at the pivoting segment 21 of the front leg frame 20. The rear leg frame 30 is then secured at the unfolding position and not rotatable relative to the front leg frame 20. To fold the high chair 100 to a smaller size, the rear leg frame 30 may be operated to rotate relative to the front leg frame 20. When the actuating assembly 402 of the folding device 40 is operated to pull the linking part 45, which will be described below in detail, and the linking part 45 successively moves the engaging part 44 to slide toward the second end 32 of the rear leg frame 30 and disengages from the recess 211, or the pivoting segment 21 in other words. The engaging part 44 now retracts back in the spindle 47 and the spindle 47 along with the connecting first end 31 of the rear leg frame 30 are rotatable relative to the pivoting segment 21 of the front leg frame 20. The rear leg frame 30 is allowed to pivot to the folding position relative to the front leg frame 20 and meanwhile the spring 46 is compressed by the engaging part 44 and the rear leg frame 30 and bears a restoring stress on the engaging part 44.

Figure 7:
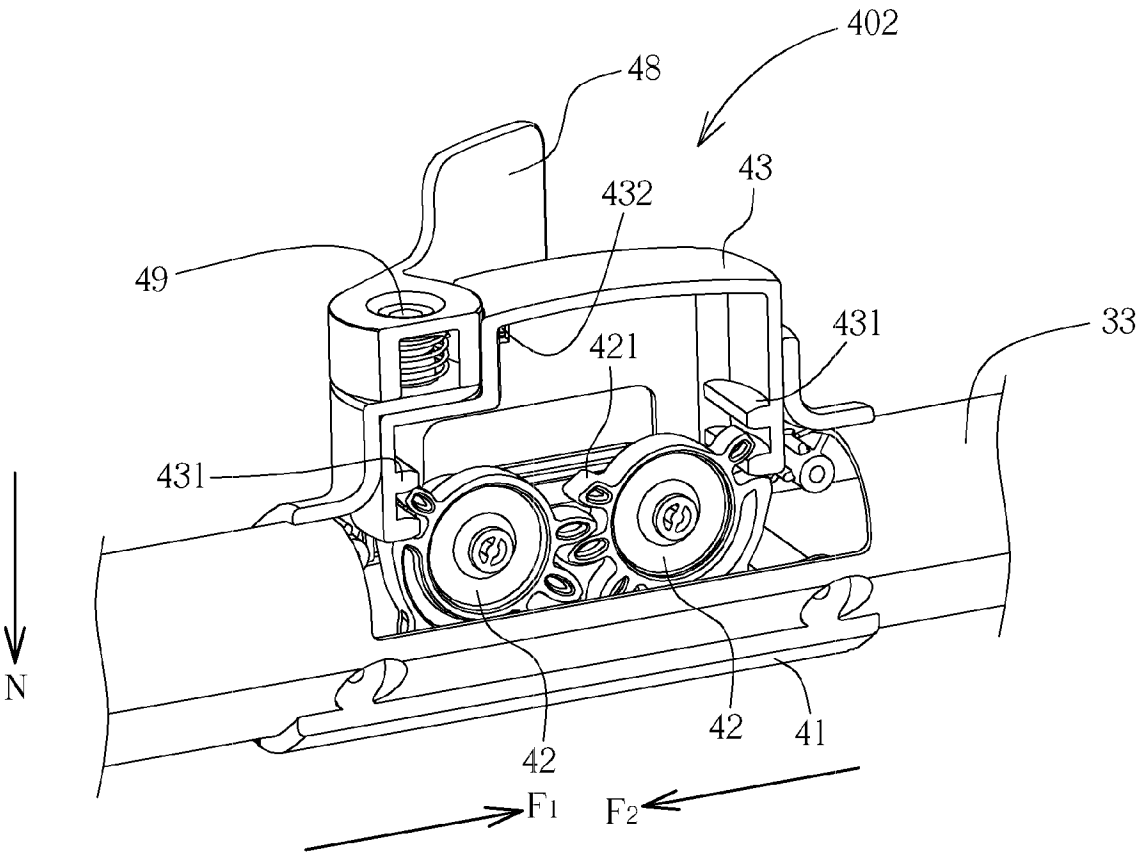
FIG. 7 is a schematic diagram of an actuating assembly of the folding device.
Figure 8:
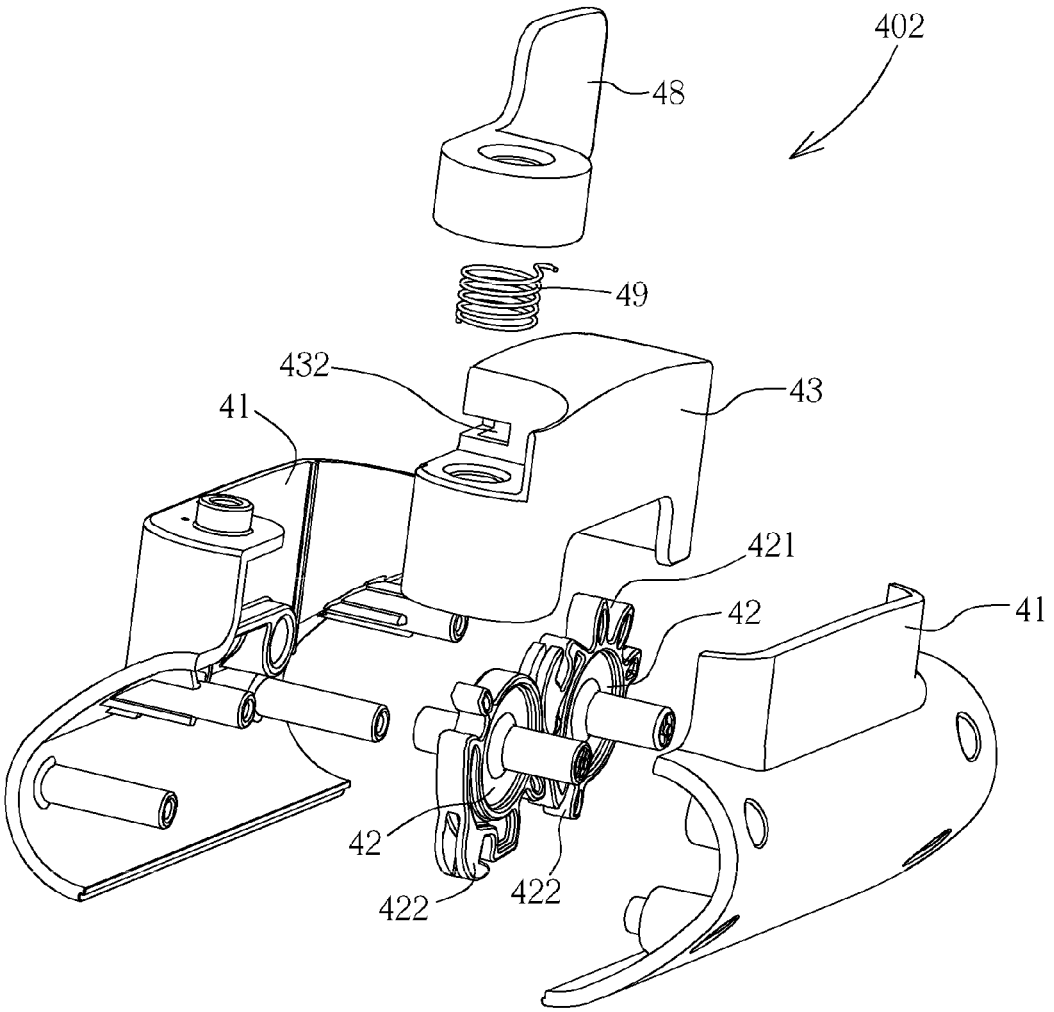
FIG. 8 is a schematic diagram of an exploded view of every component of the actuating assembly in FIG. 7.

FIG. 7 is a schematic diagram showing the actuating assembly 402 of the folding device 40 and FIG. 8 shows an exploded view of FIG. 7. The actuating assembly 402 of the folding device 40 includes a housing 41, two rotation parts (two gears 42 in the first embodiment), an actuator (button 43), and a safety locker 48. The housing 41 is mounted on the bottom pipe 33 of the rear leg frame 30, the gears 42 are rotatably mounted on the housing 41, and the button 43 is moveably mounted on the housing 41 and capable of moving up and down along direction N in FIG. 7 to extend out or locate inside the housing 41. The button 43 has protrusions 431 at the inner side that come in mesh with the teeth of the gears 42. When the button 43 moves along direction N on the housing 41, the protrusions 431 move the gears 42 to rotate. In FIG. 7, the left gear 42 rotates counterclockwise and the right gear 42 rotates clockwise. Referring to FIG. 8, each gear 42 further has a hook 422 at the bottom, or to say at the peripheral of the gear 42, and the linking part 45 or the engaging assembly 401 at one side aforementioned connects to the hook 422 of one gear 42 and to the engaging part 44 at a corresponding side. When the button 43 moves along direction N relative to the housing 41 and rotates the gears 42, the hooks 422 of the gears 42 pull the connecting linking parts 45 at two sides toward direction F1 and direction F2 respectively. In other words, pressing down the button 43 drags the steel wires inside the bottom pipe 33 to move toward the actuating assembly 402, which in turns disengages the engaging parts 44 at the first ends 31 of the rear leg frame 30 from the corresponding pivoting segments 21 at the front leg frame 20. The frame body 50 is then capable of folding.

The folding device 40 according to the embodiment of the invention further provides a safety mechanism to prevent the user from pressing the button 43 accidentally. A safety locker 48 is rotatably mounted on the housing 41 of the actuating assembly 402. A torsion spring 49 is configured between the safety locker 48 and the housing 41. When the safety locker 48 rotates relative to the housing 41, the torsion spring 49 is deformed and provides a rotational stress for the safety locker 48 so that the safety locker 48 may restore to lock the button 43.

Figure 9:
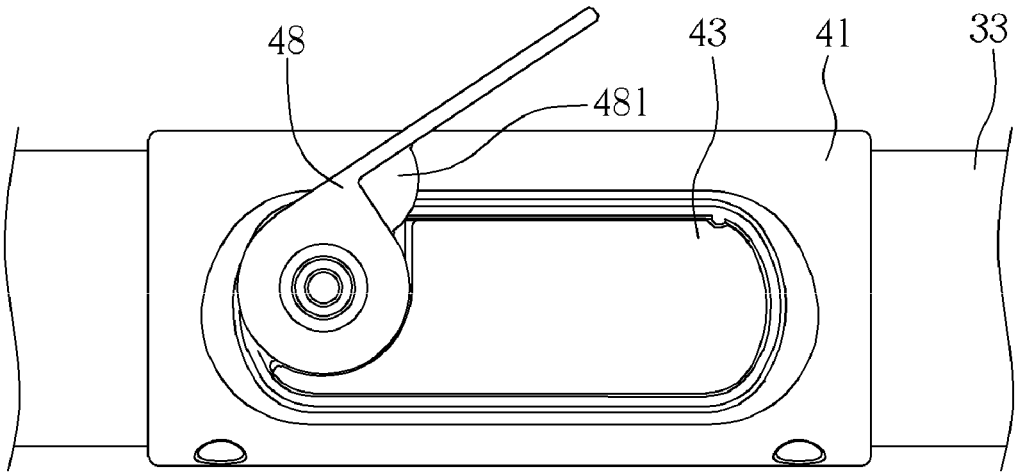
FIG. 9 is a schematic diagram of a safety locker of the actuating assembly rotating to a releasing position.
Figure 10:
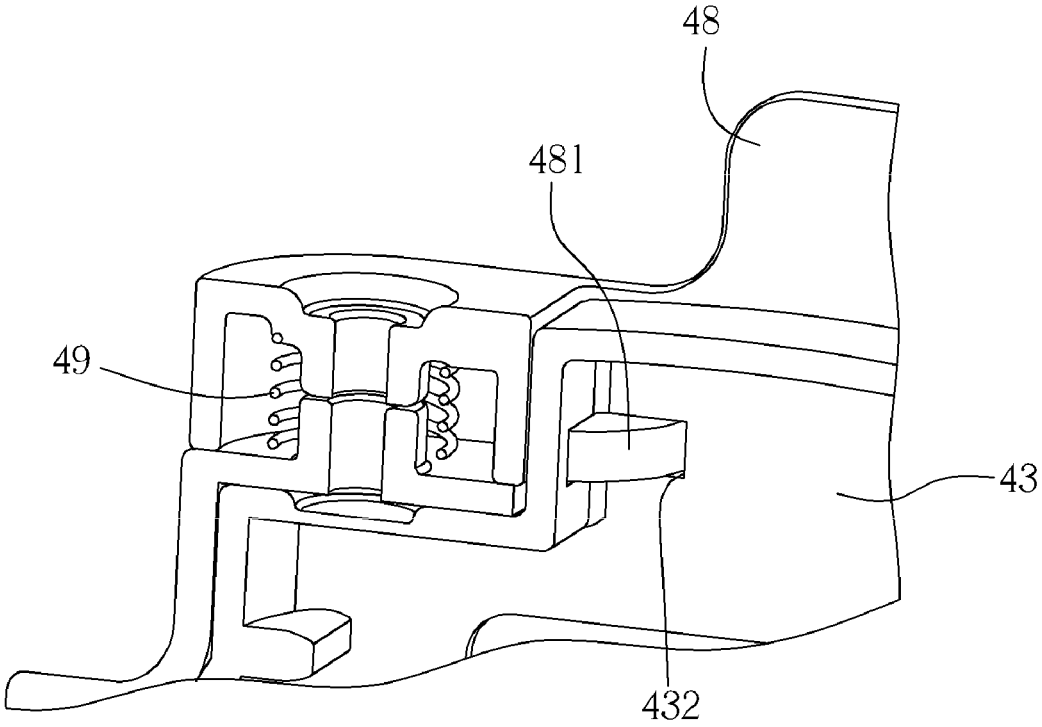
FIG. 10 is a schematic diagram of the safety locker of the actuating assembly rotating to a locking position.

FIG. 9 shows a schematic diagram of the safety locker 48 rotating to a releasing position and FIG. 10 shows a schematic diagram of the safety locker 48 that is engaging with the button 43. When the safety locker 48 is pushed to rotate to the releasing position in FIG. 9, the button 43 is no longer inhibited by the safety locker 48 and is moveable along direction N for folding the folding device 40. Since the torsion spring 49 has the rotational stress acting on the safety locker 48, the safety locker 48 may be restored to the position shown in FIG. 10 by the torsion spring 49 when the safety locker 48 is no longer pushed with a force. A locking piece 481 of the safety locker 48 extends into a slot 432 of the button 43 and inhibits the button 43 from being pressed downward along direction N. The folding device 40 is secured from being operated unintentionally.

Figure 11:
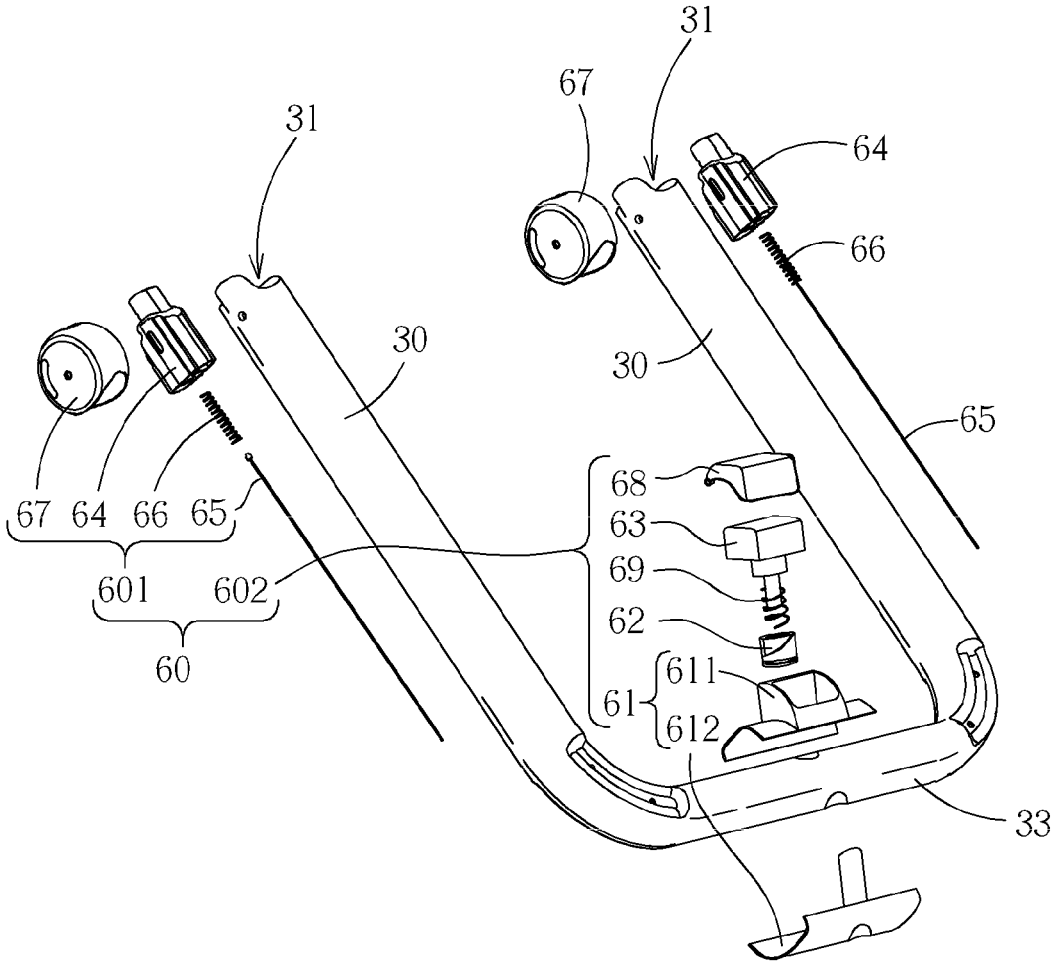
FIG. 11 is a schematic diagram of a folding device according to a second embodiment of the invention.
Figure 12:
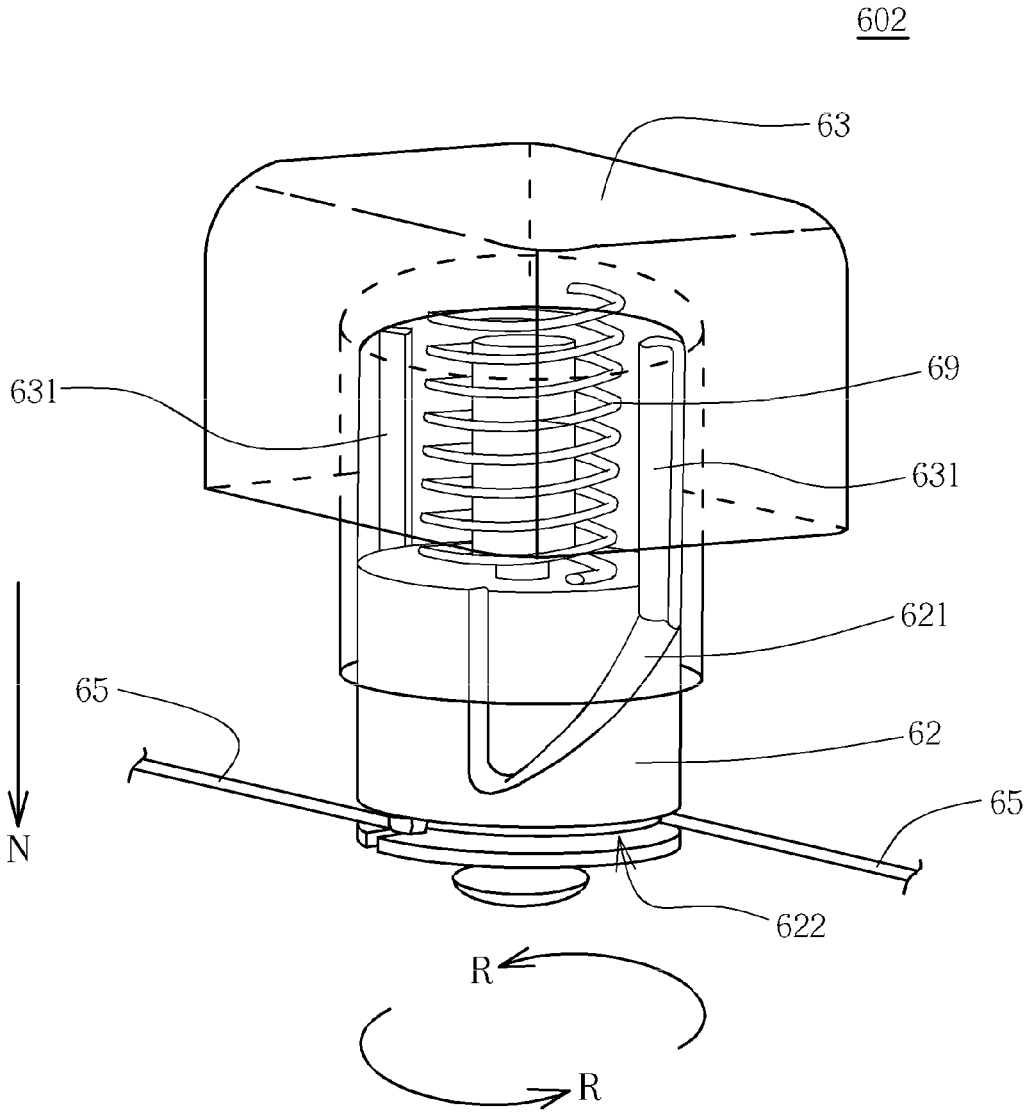
FIG. 12 is a schematic diagram of an actuating assembly of the second embodiment without showing the safety cover.

FIG. 11 shows a folding device 60 according to a second embodiment of the invention. The folding device 60 includes an engaging assembly 601 and an actuating assembly 602. The engaging assembly 601 includes an engaging part 64, a linking part 65, a spring 66, and a spindle 67 and is mounted on first end 31 of the rear leg frame 30 and pivots to the pivoting segment 21 of the front leg frame 20 in the same way as the first embodiment. Detailed description of how the engaging assembly 601 functions can be easily understood by any person skilled in the art by referring to the previously disclosed first embodiment and the description is then omitted here for brevity. In the second embodiment, the actuating assembly 602 of the folding device 60 includes a housing 61 that includes a top housing 611 and a bottom housing 612, a rotation part (a shaft 62 in the second embodiment), an actuator (a button 63), and a safety cover 68. The housing 61 is mounted on the bottom pipe 33 of the rear leg frame 30 and the shaft 62 is rotatably mounted in the housing 61. Please refer to FIG. 12. FIG. 12 is a schematic diagram of the actuating assembly 602 without showing the safety cover 68. The button 63 mounted on the housing 61 is moveable along a direction N relative to the housing 61. The button 63 also sleeves on the shaft 62. The button 63 has a rib 631 protruding on the inner wall and the shaft 62 has an inclined spiral surface 621 on the outer wall and corresponding to the rib 631. When the button 63 sleeves over the shaft 62, the rib 631 abuts against the inclined spiral surface 621 of the shaft 62 and pushes the inclined spiral surface 621 to rotate the shaft 62 along a direction R relative to the housing 61 shown in FIG. 12 as the button 63 moves downward along direction N. The linking part 65 may be a steel wire in this embodiment and placed within the hollow pipe of the rear leg frame 30. One end of the linking part 65 connects to a ditch 622 of the shaft 62 such that the linking part 65 may be rolled into the ditch 622 of the shaft 62 when the shaft 62 rotates along direction R. In other words, for the second embodiment, as a user presses the button 63 downward with his/her foot, the button 63 rotates the shaft 62 that scrolls the linking parts 65 to move toward the actuating assembly 602. Two engaging parts 64 at both sides of the first ends 31 of the rear leg frame 30 are pulled to disengage from the pivoting segments 21 of the front leg frame 20. Additionally, a restoring spring, practically a spring 69 in the second embodiment, may be further configured between the button 63 and the top housing 611 that bears a restoring stress for the button 63 as the spring 69 is compressed when the button 63 moves toward direction N. The button 63 is easy to restore to opposite of direction N due to the restoring stress provided by the spring 69.

Figure 13:
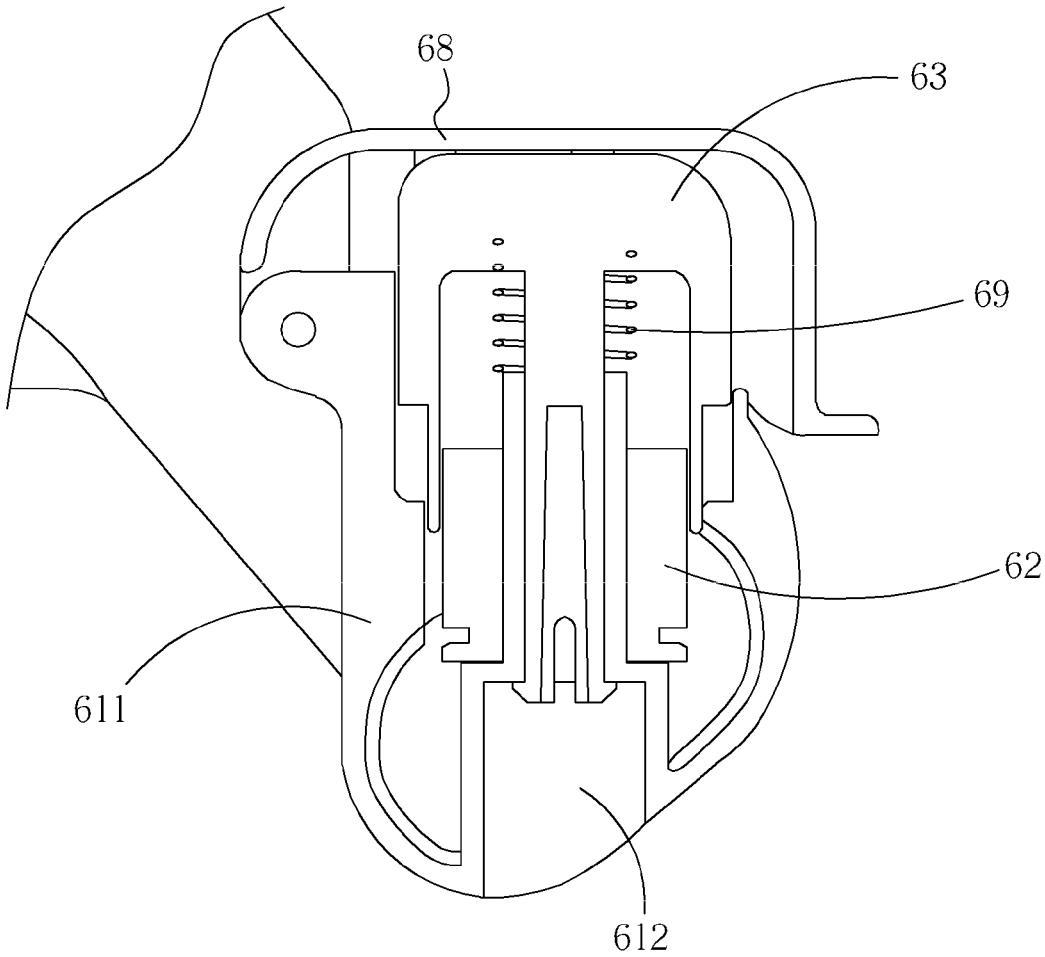
FIG. 13 is a schematic diagram of the safety cover when the safety cover is covering on the button according to the second embodiment.
Figure 14:
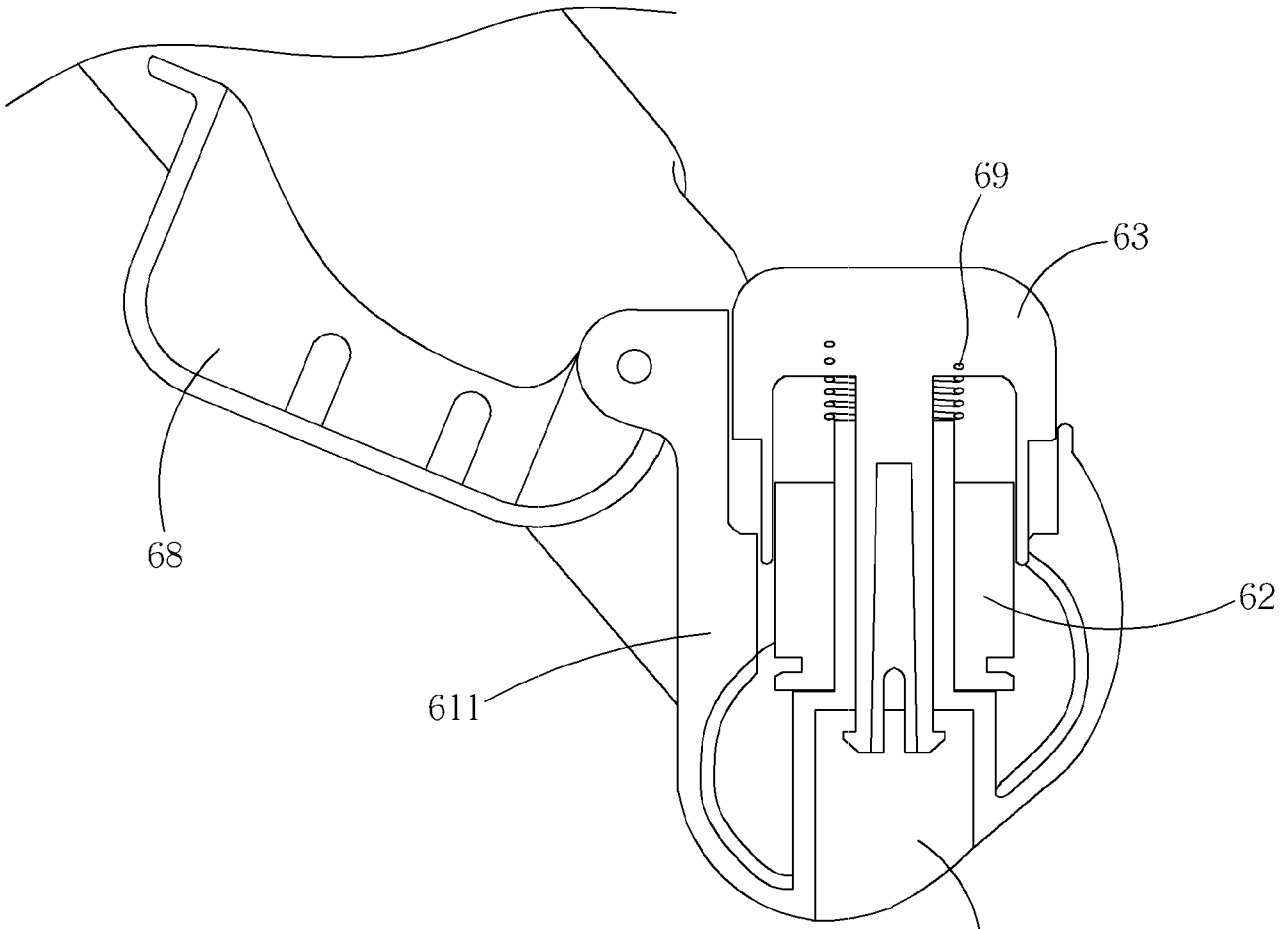
FIG. 14 is a schematic diagram of the safety cover when the safety cover is opened from the button according to the second embodiment.

Like the first embodiment, the folding device 60 according to the second embodiment also provides a safety mechanism to prevent the user from pressing the button 63 accidentally. A safety cover 68 is further configured on the button 63 and rotatable relative to the top housing 611. FIG. 13 shows a schematic diagram of the safety cover 68 when the safety cover 68 is covering on the button 63 and FIG. 14 shows a schematic diagram of the safety cover 68 opened from the button 63. Accordingly, when the safety cover 68 rotates relative to the top housing 611 to the position as shown in FIG. 13, the safety cover 68 can fully cover the button 63 such that the button 63 may not be touched or pressed to move downward along direction N unintentionally. The folding device 60 is secured from being operated unintentionally.

The folding devices disclosed in the invention are configured at the bottom of the rear leg frame and at the pivot between the rear leg frame and the front leg frame of the high chair according to the embodiments of the invention. The folding device allows a user to complete a folding process by pressing the button at the bottom of the rear leg frame. When the button is pressed, the rotator in the housing of the folding device rotates correspondingly and drags connected steel wires to move horizontally inward. The other ends of the steel wires further connect to the engaging parts at the pivots and engaging between the front leg frame and the rear leg frame and retract the engaging parts so that the rear leg frame disengages from and pivots about the front leg frame. The high chair may be folded with one-foot operation by use of the folding devices in the invention.

Those skilled in the art will readily observe that numerous modifications and alterations of the device and method may be made while retaining the teachings of the invention.

What is claimed is:

1. A high chair, comprising:

a seat;

a frame body for supporting the seat, wherein the frame body comprises a front leg frame and a rear leg frame, a first end of the rear leg frame pivots to the front leg frame, and the rear leg frame is capable of rotating relative to the front leg frame between an unfolding position and a folding position; and a folding device for allowing the rear leg frame to pivot relative to the front leg frame, the folding device comprising:

an engaging part slidably mounted on the first end of the rear leg frame, wherein the engaging part is capable of engaging with the front leg frame for securing the rear leg frame at the unfolding position;

a housing mounted on the rear leg frame and away from the engaging part;

an actuator mounted on the housing and moveable along a first direction relative to the housing, the actuator being a button comprising a rib;

a rotation part rotatably mounted on the housing, the rotation part comprising an outer wall and an inclined spiral surface; and a linking part connected between the outer wall of the rotation part and the engaging part;

wherein the actuator is sleeved on the rotation part and moves along the first direction so that the rib pushes against the inclined spiral surface to rotate the rotation part relative to the housing to move the engaging part to disengage from the front leg frame.

2. The high chair of claim 1, wherein the actuator is linked to the rotation part for rotating the rotation part to a release position relative to the housing, and when the rotation part rotates to the release position relative to the housing, the rotation part moves the engaging part to slide via the linking part and the engaging part disengages from the front leg frame.

3. The high chair of claim 2, wherein the front leg frame comprises a pivoting segment where the first end of the rear leg frame pivots to and the engaging part engages with, and when the rotation part moves the engaging part to slide via the linking part, the engaging part disengages from the pivoting segment.

4. The high chair of claim 3, wherein the pivoting segment of the front leg frame comprises a recess and the engaging part secures the rear leg frame at the unfolding position by engaging with the recess.

5. The high chair of claim 2, wherein the folding device further comprises a first elastic part connected between the engaging part and the rear leg frame for providing a restoring stress on the engaging part when the rotation part moves the engaging part to slide and disengage from the front leg frame.

6. The high chair of claim 1, wherein the folding device further comprises a cover rotatably mounted on the housing for covering over the button.

7. The high chair of claim 1, wherein the folding device further comprises a second elastic part connected between the button and the housing for providing a restoring stress on the button when the button moves along the first direction.

8. The high chair of claim 1, wherein the rotation part further comprises a ditch for containing the linking part when the button moves along the first direction and the rotation part rotates relative to the housing and rolls the linking part along a second direction into the ditch.

9. The high chair of claim 1, wherein the linking part is a steel wire.

10. The high chair of claim 1, wherein the linking part is configured within a tube of the rear leg frame.

11. The high chair of claim 1, wherein the folding device further comprises a spindle mounted on the first end of the rear leg frame and pivoting to the front leg frame, the engaging part mounted in the spindle and slidable to engage with the front leg frame by extending out of the spindle.

12. The high chair of claim 1, wherein the rear leg frame comprises a bottom pipe at a second end and the housing is mounted on the bottom pipe.

* * * * *